US007673954B2

(12) United States Patent
Inoue

(10) Patent No.: US 7,673,954 B2
(45) Date of Patent: Mar. 9, 2010

(54) IMAGE FORMING APPARATUS

(75) Inventor: Hiroshi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 221 days.

(21) Appl. No.: 11/036,033

(22) Filed: Jan. 18, 2005

(65) Prior Publication Data

US 2005/0156975 A1 Jul. 21, 2005

(30) Foreign Application Priority Data

Jan. 19, 2004 (JP) ..... 2004-010294

(51) Int. Cl.
*B41J 29/38* (2006.01)
*B41J 2/015* (2006.01)
*B41J 2/165* (2006.01)

(52) U.S. Cl. ..... 347/13; 347/20; 347/22

(58) Field of Classification Search ..... 347/13, 347/20, 22

See application file for complete search history.

(56) References Cited

U.S. PATENT DOCUMENTS

| | | | | |
|---|---|---|---|---|
| 5,398,053 | A | 3/1995 | Hirosawa et al. | |
| 6,481,820 | B1 | 11/2002 | Tamura et al. | |
| 7,044,573 | B2 * | 5/2006 | King et al. | 347/19 |
| 2004/0246293 | A1 * | 12/2004 | Sanpei et al. | 347/22 |

FOREIGN PATENT DOCUMENTS

| | | | |
|---|---|---|---|
| EP | 372895 | A2 * | 6/1990 |
| JP | 2-276647 | A | 11/1990 |
| JP | 7-314701 | A | 12/1995 |
| JP | 07314701 | A * | 12/1995 |
| JP | 9-290505 | A | 11/1997 |
| JP | 11-334047 | A | 12/1999 |
| JP | 2001-113690 | A | 4/2001 |
| JP | 2002-59568 | A | 2/2002 |
| JP | 2002059568 | A * | 2/2002 |

* cited by examiner

*Primary Examiner*—Matthew Luu
*Assistant Examiner*—Jannelle M Lebron
(74) *Attorney, Agent, or Firm*—Birch, Stewart, Kolasch & Birch, LLP

(57) ABSTRACT

The image forming apparatus in which image is formed on a recording medium by ejecting droplets onto the recording medium comprises: a plurality of ejection ports through which the droplets are ejected; a line head in which the ejection ports are aligned along a length corresponding to an entire width of the recording medium; a head recovery device which performs a head recovery processing to recover from a defect of the ejection ports in the line head; a head retracting device which moves the line head to a retracted position for performing the head recovery processing; and an auxiliary head which is movable in a direction substantially perpendicular to a conveyance direction of the recording medium, wherein the auxiliary head records the image onto the recording medium while the head recovery processing is performed to the line head in the retracted position.

21 Claims, 7 Drawing Sheets

IMAGE FORMING APPARATUS

BACKGROUND OF THE INVENTION

1. Field of the Invention

The present invention relates to an image forming apparatus, and more specifically to an image forming apparatus that requires regular head maintenance, such as an inkjet recording apparatus that performs printing to form an image by ejecting ink from an ink ejection head, in which maintenance of the head can be performed during printing.

2. Description of the Related Art

Conventionally, one known example of an image forming apparatus is an inkjet recording apparatus (inkjet printer) that has an inkjet head (ink ejection head) with an alignment of multiple nozzles and that forms an image on a recording medium by ejecting ink from the nozzles while moving the inkjet head and the recording medium relative to each other.

Various methods are known in conventional practice as ink ejection methods for such an inkjet recording apparatus. Known examples include a piezoelectric system wherein a vibration plate that constitutes part of a pressure chamber (ink chamber) is deformed by the deformation of a piezoelectric element (piezoelectric ceramic), the capacity of the pressure chamber is changed, ink is led into the pressure chamber from an ink supply channel during this increase in pressure chamber capacity, and the ink in the pressure chamber is ejected as droplets during the decrease in pressure chamber capacity. Further, known examples also include a thermal inkjet system wherein ink is heated to create air bubbles for ejecting the ink by the expansion energy when the air bubbles grow.

In an image forming apparatus that has an ink ejection head, such as an inkjet recording apparatus, ink is supplied from an ink tank that stores ink to an ink ejection head via an ink supply channel, and the ink is ejected by the ejection methods described above. The ink used herein is preferably dried and fixed immediately upon being ejected onto the recording medium.

Since ink always fills the nozzles of the ink ejection head so that printing can be immediately carried out when a print command is received, and ink ejection of ink from the nozzles becomes unstable when the ink in the nozzles dries, the ink ejection head is sealed with a cap to ensure that the ink in the nozzles does not dry during standby.

However, in the nozzles which do not eject the ink for a long time during printing, since the ink in the nozzles is exposed to the air, the drying and the viscosity of ink in the nozzles is increased. Therefore, since the nozzles become clogged or have no ink for ejecting, there is a problem to hinder the ink from being ejecting. In order to solve the problem, a purging operation must be performed to forcefully eject the ink from the nozzles at regular intervals.

When air bubbles that are mixed in the ink supply channel and the like accumulate in the ink ejection head or in front of the filter for removing impurities from the ink supply channel, ink cannot be ejected from the nozzles. Therefore, there is a problem to block ink from supplying by the accumulated air bubbles.

Furthermore, when ejection continues over an extended period, the refill of ink is slowed, nozzle pressure becomes too low, and ink ejection becomes unstable. Therefore the nozzle pressure must be periodically reset to its initial state by suctioning the ink from the nozzles with a pump.

Staining of the nozzle surface by splashes or by the ejected ink ricocheting off the printing surface may be the cause of ejection failure or the like, therefore the nozzle surface must be periodically cleaned by using a blade on (wiping) the nozzle surface.

In order to deal with such causes of ink ejection failure in an inkjet recording apparatus, various methods have been proposed in conventional practice.

One known example of a piezoelectric inkjet recording apparatus is an apparatus wherein ink in the ink chamber is made to oscillate by applying an AC electric field to the piezoelectric oscillator of the dot for which not ink is ejected during recording (during printing), and the ink in the ink chamber is made to flow to prevent the ink from drying (for example, see Japanese Patent Application Publication No. 9-290505).

Another example is one wherein a conveyor belt for conveying the recording paper is provided with a plurality of ports at specific intervals in the direction in which the recording paper is conveyed (for example, see Japanese Patent Application Publication No. 2001-113690). In the inkjet recording apparatus, the ink is ejected from the print head to each of the plurality of ports during printing, and the ejected ink is recovered via the conveyor belt by a recovery mechanism device disposed so as to face the print head. Therefore, a purging operation is performed during printing.

Yet another example is one having a line head with a plurality of nozzles disposed along a length equivalent to the width of the recording medium, wherein an auxiliary head with an image recording width equal to or greater than the image recording width of the line head, or an auxiliary head capable of moving in the line direction of the line head, is in parallel alignment with the line head (for example, see Japanese Patent Application Publication No. 11-334047). When the nozzles in the line head have a defect, the image is formed by using the auxiliary head aligned parallel to the line head.

Furthermore, still another example is one having a linear recording head and a serial recording head capable of moving in the direction that the nozzles are aligned in the linear recording head (for example, see Japanese Patent Application Publication No. 2-276647). When nozzles incapable of ejecting ink are detected in the linear recording head, the location of these nozzles is recorded by the serial recording head.

However, the example disclosed in Japanese Patent Application Publication No. 9-290505 has the effect of preventing the ink in the nozzles from increasing in viscosity or solidifying during printing, but ink cannot be suctioned and the nozzle surface cannot be cleaned with a blade during printing.

In the example disclosed in Japanese Patent Application Publication No. 2001-113690, the purging operation can be performed during printing, but ink cannot be suctioned and the nozzle surface cannot be cleaned with a blade during printing.

The example disclosed in Japanese Patent Application Publication No. 11-334047 is not configured so that the recovery processing can be performed on the nozzles in the main line head incapable of ejecting ink while the auxiliary head is being used for ejecting.

The example disclosed in Japanese Patent Application Publication No. 2-276647 is not configured so that the recovery processing can be performed on the main linear recording head while the auxiliary head (serial recording head) is being used for ejecting. In addition, the auxiliary head disclosed in Japanese Patent Application Publication No. 2-276647 has one nozzle, and images cannot be formed without the main linear recording head by merely compensating for the omission of dots by the nozzles in the main linear recording head incapable of ejecting ink.

Therefore, there are conventional problems in which neither a purging operation for removing the cause of such ejection failures previously described, nor head maintenance operations such as suction and cleaning with a blade can be performed during printing by placing the recording medium directly underneath the head during printing, when using a line head in which only a number of nozzles corresponding to the entire width of the recording medium are aligned in a line configuration in the width direction of the recording medium.

SUMMARY OF THE INVENTION

The present invention has been contrived in view of such circumstances, and an object thereof is to provide an image forming apparatus that can improve productivity by performing the maintenance operation according to the print head during printing even if the printing-defects such as the fault of ink ejection occur.

In order to attain the aforementioned object, the present invention is directed to an image forming apparatus in which an image is formed on a recording medium by ejecting droplets onto the recording medium, comprising: a plurality of ejection ports through which the droplets are ejected; a line head in which the ejection ports are aligned along a length corresponding to an entire width of the recording medium; a head recovery device which performs a head recovery processing to recover from a defect of the ejection ports in the line head; a head retracting device which moves the line head to a retracted position for performing the head recovery processing; and an auxiliary head which is movable in a direction substantially perpendicular to a conveyance direction of the recording medium, wherein the auxiliary head records the image onto the recording medium while the head recovery processing is performed to the line head in the retracted position.

According to the present invention, even if ejection failures and other such defects occur in the main line head, maintenance to the line head is performed while printing is performed by the auxiliary head. Therefore, since printing is not interrupting during the maintenance, productivity can be improved. It is also possible to recover nozzles incapable of ejection during printing, and reliability of printing can be improved.

Preferably, the line head is configured by disposing a plurality of ejection heads having the plurality of ejection ports so as to cover the entire width of the recording medium, and each of the ejection heads is movable independently by the head retracting device. The auxiliary head preferably records the image onto a part or onto all of an image recording area for being recorded by the line head while the head recovery processing is performed to the line head.

Therefore, the recovery processing can be performed sequentially on each ejection head constituting the line head, the recovery processing is not performed needlessly, the amount of wasted ink can be reduced, and there is no decrease in productivity.

Preferably, the auxiliary head reciprocates in the direction substantially perpendicular to the conveyance direction of the recording medium so as to record the image onto the recording medium. In addition to so-called shuttle printing, this two-way movement includes minute oscillations involving reciprocation in small increments over very small distances, whereby it is possible to reduce printing irregularities and joints between the ejection heads constituting the line head.

Also, the auxiliary head preferably reciprocates in the direction substantially perpendicular to the conveyance direction of the recording medium so as to record the image onto the recording medium. The properties of the apparatus according to mass production can be improved by using the same unit for the ejection heads constituting the line head and the auxiliary head.

Furthermore, the auxiliary head is preferably provided with a print determination device for determining whether the recording medium has been printed. Therefore, it is possible to reliably correct joints between the ejection heads constituting the line head.

As described above, according to the image forming apparatus of the present invention, it is possible to perform maintenance on the main line head while printing by the auxiliary head instead of the main line head, even if any defects occur in the main line head. Therefore, productivity thereof can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
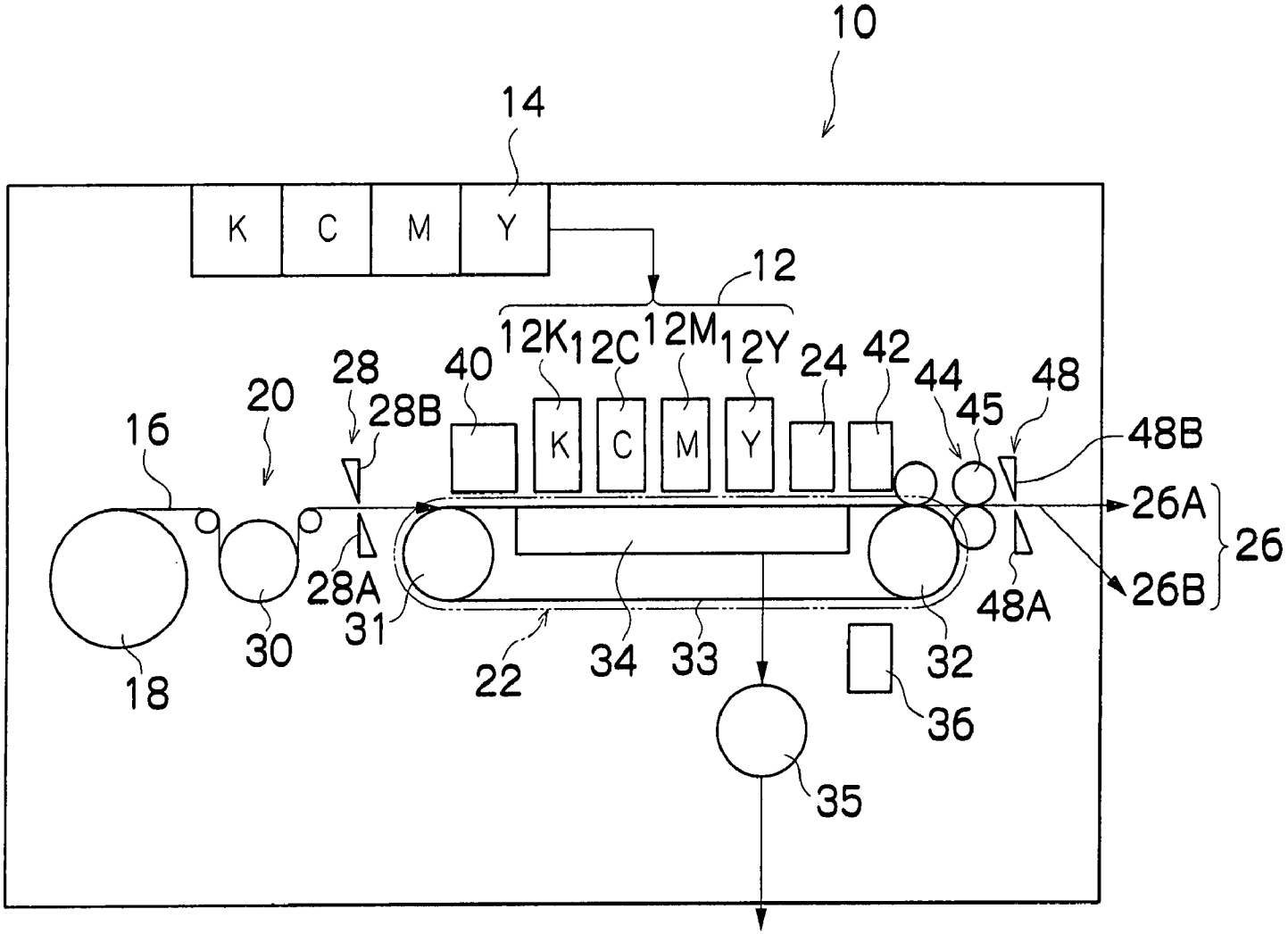
FIG. 1 is a general schematic drawing of an inkjet recording apparatus according to first embodiment of the present invention.

FIG. 1 is a general schematic drawing of an inkjet recording apparatus according to first embodiment as an image forming apparatus of the present invention. As shown in FIG. 1, the inkjet recording apparatus 10 comprises: a printing unit 12 having a plurality of droplet ejection heads or print head units 12K, 12C, 12M, and 12Y for ink colors of black (K), cyan (C), magenta (M), and yellow (Y), respectively; an ink storing/loading unit 14 for storing inks to be supplied to the print head units 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity, of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 comprises the print heads units 12K, 12C, 12M, and 12Y corresponding to four ink-colors (KCMY). Each of the print head units 12K, 12C, 12M, and 12Y forms a so-called full-line head in which a line head is configured by arranging long side of a plurality of ejection heads including a plurality of ejection apertures to a length that corresponds to the maximum paper width and is disposed in perpendicular direction to the delivering direction of the recording paper 16. A specific structural example is described following, the print head units 12K, 12C, 12M, and 12Y are equipped with various devices for determining an ink-ejecting condition, the size of ejected ink-droplet, the speed of ejected ink, and the like (for example, a detection device for determining the ejected ink, an optical system for forming the predefined shape of luminous flux for determining, an auxiliary head, and the like).

The print head units 12K, 12C, 12M, and 12Y for the respective colors are arranged in this order from the upstream side (the left-hand side in FIG. 1) along the delivering direction of the recording paper 16 (hereinafter referred to as the paper conveyance direction). A color print can be formed on the recording paper 16 by ejecting the inks from each heads of the print head units 12K, 12C, 12M, and 12Y, respectively, onto the recording paper 16 while conveying the recording paper 16.

Although the configuration with the KCMY four standard colors is described in the embodiment, combinations of the ink colors and the number of colors are not limited to those, and light and/or dark inks can be added as required. For example, a configuration is possible in which print heads for ejecting light-colored inks such as light cyan and light magenta are added.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print head units 12K, 12C, 12M, and 12Y, and the tanks are connected to the print head units 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor (a line sensor, etc.) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the embodiment is configured with at least a line sensor having rows of photoelectric transducing elements with a width that is greater than the ink-droplet ejection width (image recording width) of the print head units 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print head units 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the droplet ejection heads or the print head units is described. The print head units 12K, 12C, 12M, and 12Y provided for the respective ink colors have the same structure, and a reference numeral 50 is hereinafter designated to any of the print head units 12K, 12C, 12M, and 12Y.

Figure 2A:
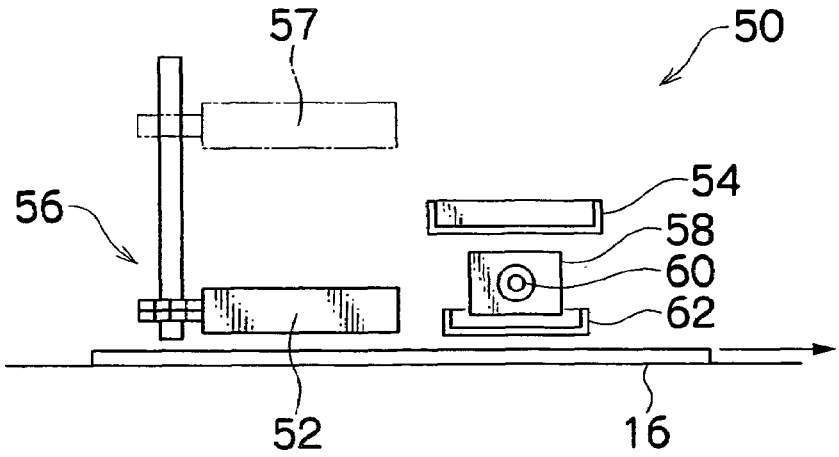
FIG. 2A is a side view showing the schematic configuration of an example of a print head unit according to the first embodiment during normal printing.
Figure 2B:
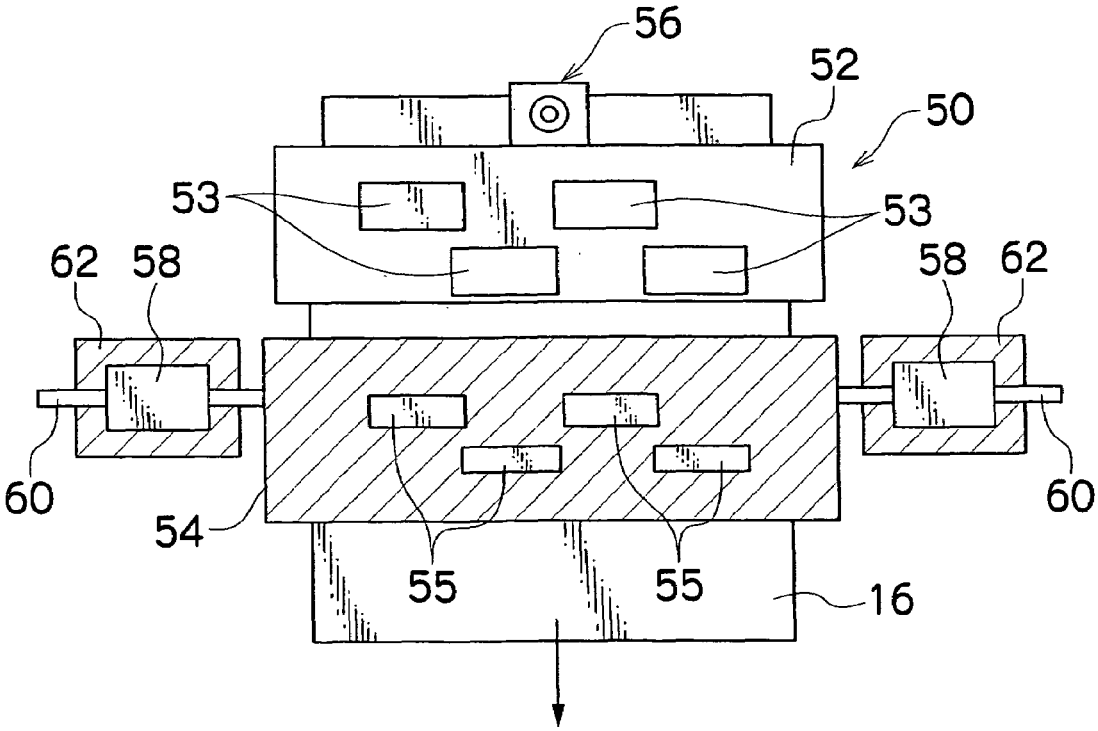
FIG. 2B is a plan view thereof.

FIGS. 2A and 2B show the schematic configuration of a print head unit 50 according to the first example of the present invention. FIGS. 2A and 2B show the state of a print head unit 50 during normal printing, where FIG. 2A is a side view and FIG. 2B is a plan view.

As shown in FIG. 2A, the print head unit 50 of the present example is primarily comprising: a print head (hereinafter referred to as main head) 52 that ejects ink to record images on the recording paper 16; a maintenance unit (head recovery device) 54 that performs maintenance on the main head 52; a head retracting device (vertical retracting mechanism) 56 that moves the main head 52 to a retracted position for performing the recovery processing; and auxiliary heads (sub-heads) 58 that print instead of the main head 52 while maintenance (the recovery processing) is performed on the main head 52.

As shown in FIG. 2B, in the main head 52, a plurality of rectangular ejection heads 53 having a plurality of ejection ports (nozzles, not shown) aligned in a matrix configuration are disposed in a staggered pattern in the direction orthogonal to the direction in which the recording paper 16 is conveyed, as shown by the arrow in the diagram, and the ejection heads 53 together form a line head with a length corresponding to the maximum width of the recording paper 16.

The main head 52 can be moved by the head retracting device 56 from the normal printing position shown by the shaded areas in FIG. 2A to a retracted position 57 shown by the chain line. In the present example, the main head 52 is configured as a line head by the plurality of ejection heads 53, and the plurality of ejection heads 53 move the entire main head 52 together as a unit. Thus, in the present example, joints between the ejection heads 53 are prevented from becoming misaligned by moving the main head 52 as a unit.

The maintenance unit 54 is configured by disposing caps 55 in a staggered pattern in correspondence with the ejection heads 53 of the main head 52, as shown in FIG. 2B. When the main head 52 moves to the retracted position 57, the maintenance unit 54 moves as a unit in the opposite direction from the one in which the recording paper 16 is conveyed by a driving device (not shown). Then, the maintenance unit 54 is positioned on the underside of the main head 52 that has moved to the retracted position 57.

The auxiliary heads 58 have the same shape and configuration as the ejection heads 53 constituting the main head 52, and are supplied with ink of the same color as in the main head 52. In addition, the auxiliary heads 58 are configured so as to be moved along a driving shaft 60 in the width direction of the recording paper 16 (the direction substantially perpendicular to the paper conveyance direction) by the driving device (not shown). The auxiliary heads 58 remain in standby mode on the outer side in the width direction of the recording paper 16 during normal printing, and maintenance units 62 for the auxiliary heads 58 are provided underneath the auxiliary heads 58 in this standby position.

Figure 3A:
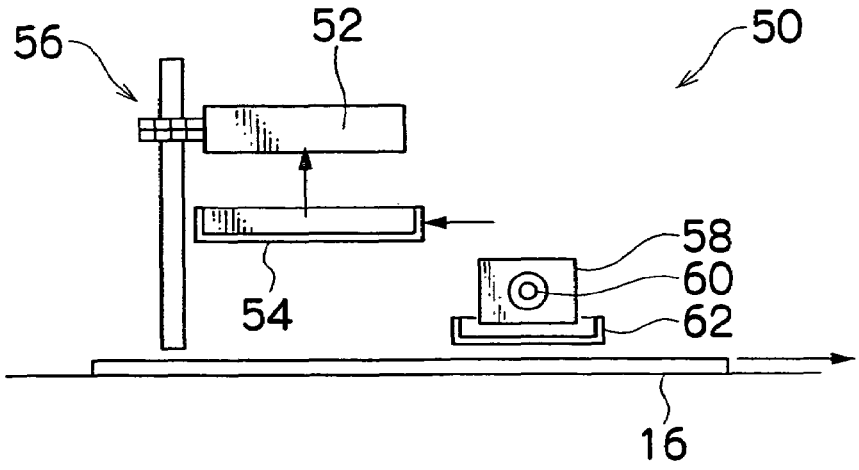
FIG. 3A is a side view showing the schematic configuration of the example of a print head unit according to the first embodiment during maintenance.
Figure 3B:
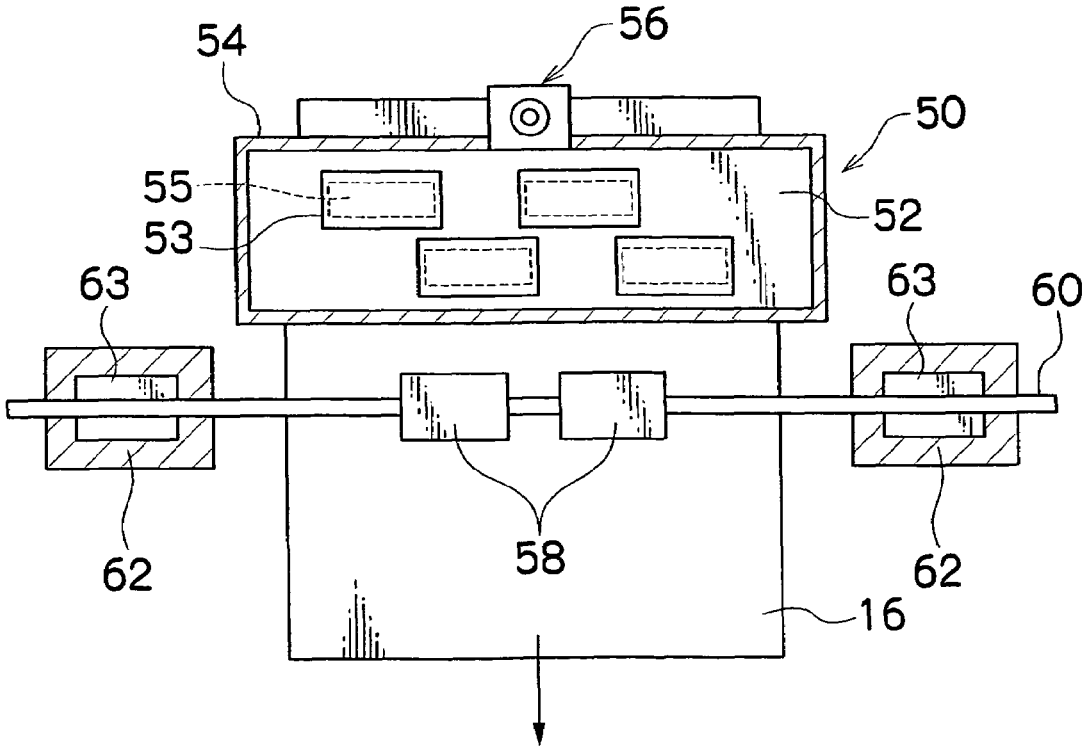
FIG. 3B is a plan view thereof.

FIGS. 3A and 3B show the state of the print head unit 50 during maintenance. FIG. 3A is a side view thereof, and FIG. 3B is a plan view.

When the maintenance operation is performed, the main head 52 is moved to a retracted position above the position during normal printing by the head retracting device 56, as shown in FIG. 3A. The maintenance unit 54 is moved by a driving device (not shown) to the underside of the main head 52 that has retracted to the retracted position.

The caps 55 of the maintenance unit 54 reach positions corresponding exactly to the ejection heads 53 of the main head 52 as shown in FIG. 3B, and perform maintenance on the main head 52. Furthermore, the auxiliary heads 58 move above the recording paper 16 along the driving shaft 60 and record images in place of the main head 52. It is thereby possible to perform maintenance during printing.

The maintenance units 62 of the auxiliary heads 58 are also provided with caps 63 for the auxiliary heads 58, as shown in FIG. 3B.

Examples of maintenance include "purging," (so-called "expulsion") which involves increasing the pressure on the ink in the nozzles and forcefully expelling the ink into a recovery tray or the like; "suction," which involves sealing the heads with caps and drawing out the ink from the exterior with a pump communicated with the caps; and "blade cleaning," which involves cleaning the nozzle surface by scraping. These maintenance operations are described in detail later, and can be suitably alternated in specific cycles or combined.

Two auxiliary heads 58 are used as shown in the diagrams, but images may be recorded using only one. Images are recorded over the entire length of the recording paper 16, but unsatisfactory portions alone may also be printed when locations where the main head 52 did not print satisfactorily are detected.

Next, the maintenance operation to the main head 52 in the first embodiment is described below.

When the maintenance to the main head 52 is performed, the print data is buffered to a specific memory region, ejection of ink from the main head 52 is halted, and the task of ejection is transferred to the auxiliary heads 58. The buffered print data is delivered in response to the movement of the auxiliary heads 58. The auxiliary heads 58 performs shuttle scanning according to the delivered print data and records images instead of the main head 52.

While the task of ejecting ink is transferred from the main head 52 to the auxiliary heads 58, the main head 52 is lifted up by the head retracting device 56 and is retracted to the retracted position 57 as shown in FIG. 2A. Then, the maintenance unit 54 is moved by a driving device, and the maintenance unit 54 is inserted between the main head 52 and the recording paper 16 (on the underside of the main head 52), as shown in FIG. 3A.

The caps 55 of the maintenance unit 54 are disposed at the positions of each ejection heads 53 in the main head 52 to perform the maintenance operation. As described above, the maintenance operation may be purging, suctioning, or blade cleaning; but the relationships between $t_2=M\times t_1$ and $t_3=N\times t_1$, which show the purging cycle as $t_1$, show the suction cycle as $t_2$, and show the blade cleaning cycle as $t_3$, are preferably satisfied in order to decrease the number of the needed maintenance times if M and N are specific positive integers. For example, when purging is performed after every 10,000 ejections, the suctioning and the blade cleaning are performed in synchronization with the purging cycles, such as the suctioning after every 20,000 ejections and the blade cleaning after every 40,000 ejections.

Purging is performed with the caps 55 disposed directly underneath the ejection heads 53 targeted for maintenance. At this time, it is acceptable that the ejection heads 53 come in no contact with the caps 55. During suctioning, the caps 55 are pressed against the ejection heads 53 targeted for maintenance, and a suction pump (not shown) arranged with downstream of the caps 55 is driven to suction out the ink. During blade cleaning, the nozzle surfaces of the ejection heads 53 are wiped clean with a rubber member or another such flexible member disposed in or near the caps 55. At this time, purging is not performed when suctioning is performed.

After the maintenance operation (recovery processing) is completed, the maintenance unit 54 is retracted to its original position by a driving device (not shown), and the main head 52 that has undergone maintenance is moved down to its original ejection position by the head retracting device 56. If the main head 52 is positioned at the ejection position of the recording paper 16, the task of the ejection is transferred from the auxiliary heads 58 to the main head 52, and then the auxiliary heads 58 are retracted to their original positions (standby positions). The maintenance units 62 for the auxiliary heads 58 are set at the standby positions of the auxiliary heads 58, where the auxiliary heads 58 undergo maintenance while remaining in standby until the next maintenance operation is performed on the main head 52.

Thus, in the first embodiment, there is no decrease of productivity because images are recorded by the auxiliary heads 58 while the main head 52 undergoes maintenance. Addition, there are no problems of displacement between the ejection heads 53 constituting the main head 52 because the main head 52 is designed to be moved as a unit.

Figure 4:
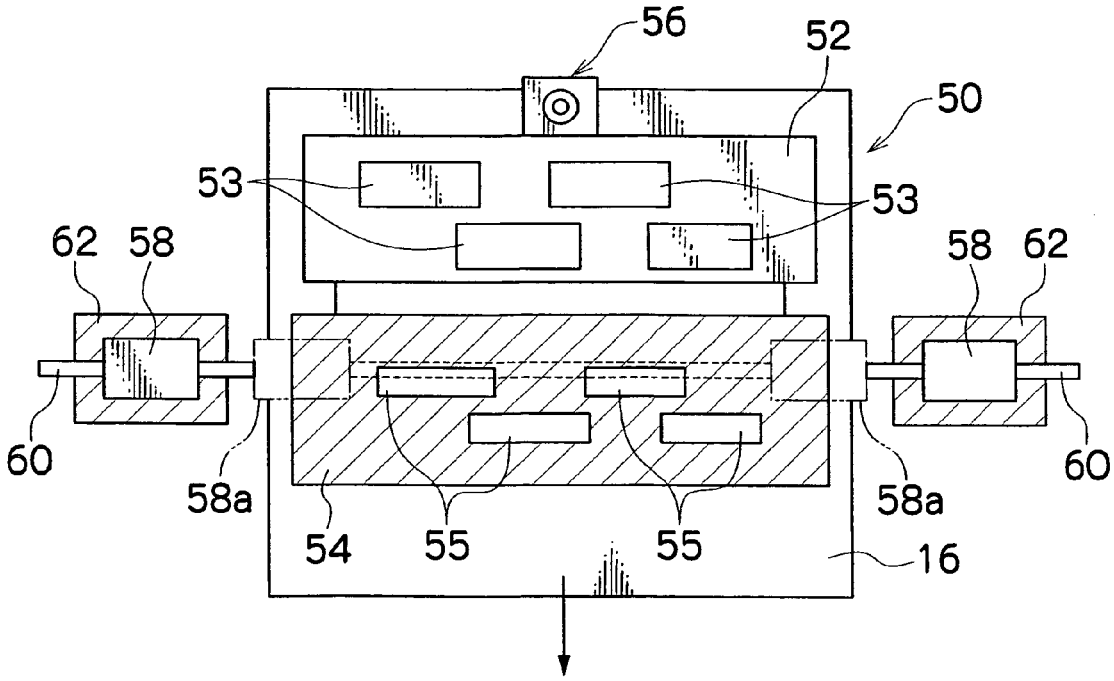
FIG. 4 is a plan view showing the schematic configuration of another example of a print head unit according to the first embodiment.

Also, in the present example, as shown in FIG. 4, while the auxiliary heads 58 are moved to the position 58*a* shown by a chain double-dashed line in the diagram, the sections on the outer side of the ejection heads 53 of the main head 52 are printed by the auxiliary heads 58, so that the maximum paper width can be enlarged. However, when the auxiliary heads 58 are used to enlarge the maximum paper width in this manner, maintenance cannot be performed during printing.

Next, a second embodiment of the present invention is described. The second embodiment is designed such that the ejection heads constituting the main head can be retracted upward individually during maintenance.

Figure 5A:
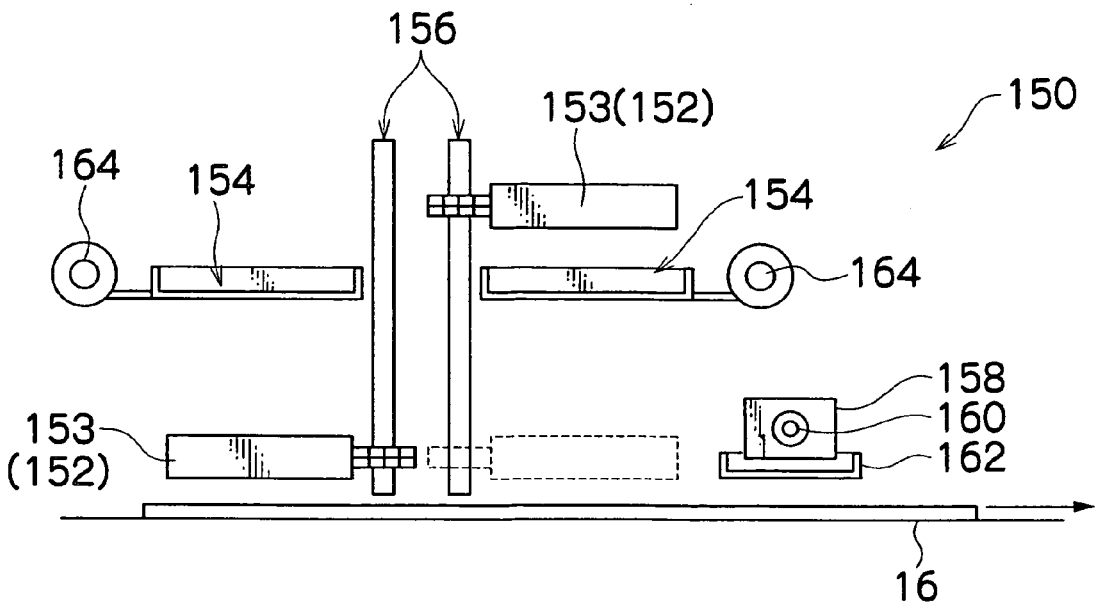
FIG. 5A is a side view showing the schematic configuration of an example of a print head unit according to second embodiment of the present invention.
Figure 5B:
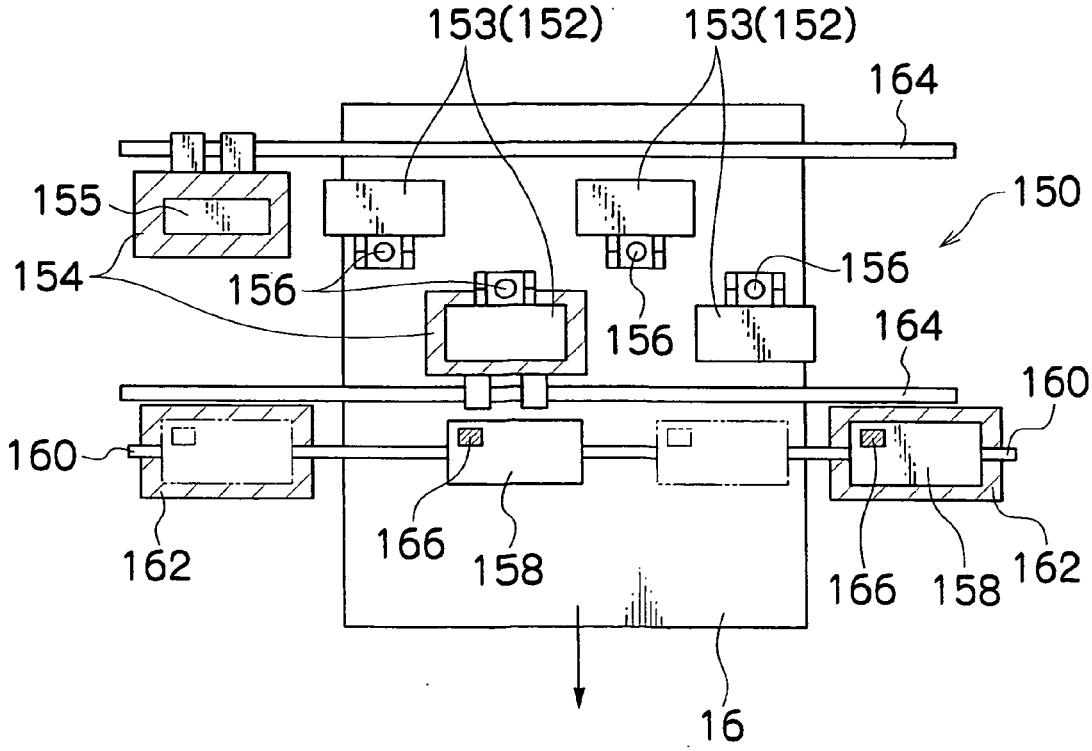
FIG. 5B is a plan view thereof.

FIG. 5A is a side view showing the schematic configuration of an example of a print head unit according to the second embodiment of the present invention, and FIG. 5B is a plan view thereof.

As shown in FIG. 5A, in the second embodiment, each of the rectangular shaped ejection heads 153 is attached to each of the head retracting devices 156, and the ejection heads 153 are designed to move up and down individually. Also, as shown in FIG. 5B, the ejection heads 153 are disposed in a staggered pattern in the width direction of the recording paper 16, and are configured such that the recording section is arranged so as to be able to cover the entire width of the recording paper 16, thus forming a main head 152 as a whole.

Also, each maintenance units 154 in the second embodiment has the caps 155, and are configured so as to move individually. As shown in FIG. 5A, the maintenance units 154 are configured to be set between the ejection heads 153 retracted to the upper retracted position and the recording paper 16 at the vertically standpoint. As shown in FIG. 5B, the maintenance units 154 are configured to be capable of moving from the outer side of the recording paper 16 in the width direction of the recording paper 16 (the direction substantially perpendicular to the paper conveyance direction) along a drive shaft 164 at a horizontal standpoint.

The auxiliary heads 158 in the second embodiment are similar to the auxiliary heads 58 in the first embodiment described above, and have the same shape and configuration as the ejection heads 153 constituting the main head 152. Also, the auxiliary heads 158 are capable of moving in the width direction of the recording paper 16 along a drive shaft 160, and are designed to normally remain in standby at the positions of the maintenance units 162 for the auxiliary heads 158 on the outer side in the width direction of the recording paper 16.

According to the second embodiment, since the ejection heads 153 constituting the main head 152 are capable of moving individually, it is possible to retract only one ejection head 153 to perform maintenance. Therefore, since the section on the recording paper 16 corresponding to the ejection head 153 targeted for maintenance must be printed with the auxiliary heads 158, the auxiliary heads 158 are provided with sensors 166 to accurately determine the position thereof. The sensors 166 are not particularly limited, and reflective sensors can be installed in the carriage of the auxiliary heads 158, for example.

Preferably, the position printed on the recording paper 16 by the ejection heads 153 is determined in advance by utilizing the nozzle check time prior to the printing operation. For example, after the ejection heads 153 constituting the main head 152 eject ink in order to print a test chart during the nozzle check, the reflective sensors 166 determine whether ink is present or not, and then the position of the carriage of the auxiliary heads 158 at the time is memorized.

Next, the maintenance operation in the second embodiment is described as the characteristics according to the second embodiment.

When the maintenance operation is performed, ejection of ink from the ejection heads 153 constituting the main head 152 targeted for maintenance is halted, and then the corresponding ejection task is transferred to the auxiliary heads 158. In other words, after the auxiliary heads 158 are moved to the recording section on the recording paper 16 that corresponds to the ejection-heads 153 targeted for maintenance, the print data handled by the ejection heads 153 targeted for maintenance is sent to the auxiliary heads 158, and then images are recorded by the auxiliary heads 158.

When the ejection task is transferred from the ejection heads 153 to the auxiliary heads 158, the ejection heads 153 targeted for maintenance are lifted up by the head retracting devices 156 and are retracted to the retracted positions as shown in FIG. 5A. Then, while the maintenance units 154 having the caps 155 are moved along the drive shaft 164, the maintenance units 154 are inserted between the ejection heads 153 and the recording paper 16 (underneath the ejection heads 153) to perform the maintenance operation as shown in FIG. 5A.

For the frequency by which the maintenance operation is performed, the suctioning and the blade cleaning may be performed in synchronization with the purging cycle in the same way as the first embodiment described above. In this case, the time until the next maintenance cycle may be calculated based on the print data, as described later.

For example, in the case in which the ejection state of the ejection heads 153 is determined from the print data, it is possible to calculate the time $T_1$ until the next ejection of the ejection heads 153. If the maintenance cycle is determined, the remaining time $T_2$ until maintenance is determined by subtraction from the maintenance cycle. If the time for transferring to the substitute ejection by the auxiliary heads 158 is $T_3$, and the time for returning is $T_4$, the ejection heads 153 are transferred to a dormant state and are applied to the caps 155 when the relationship of $T_1>T_3+T_4+\alpha$ is satisfied (i.e., when there is sufficient time until the next ejection). During the return process, the ejection heads 153 are transferred to their print standby positions after purging toward the caps 155. At this time, the auxiliary heads 158 remain at their standby positions above the maintenance units 162 for the auxiliary heads 158, and there is no need to move the auxiliary heads 158.

When the remaining time $T_2$ until the next maintenance cycle is the same as the time $T_3$ for transferring to the substitution ejection by the auxiliary heads 158 (i.e. $T_2-T_3=0$), the maintenance operation to the ejection heads 153 is performed while substitution ejection is performed by the auxiliary heads 158.

In the present example according to the second embodiment, since the ejection heads 153 constituting the main head 152 are capable of being retracted individually, it is necessary to combine exactly with each image recorded sections formed by each ejection heads 153. In order to cope with those, the printing operation may be switched accordingly, depending on the printing mode. For example, during the normal printing mode and the high-speed printing mode, the auxiliary heads 158 are moved to the positions of the ejection heads 153 in the main head 152 that are targeted for maintenance, which the positions of ejection heads 153 are determined beforehand and stored as previously described, and then the auxiliary heads 158 perform ejection in a fixed state.

Otherwise, instead of determining and storing in advance the positions on the recording paper 16 that correspond to the ejection heads 153 targeted for maintenance, the borders between the image recorded sections formed by the ejection heads 153 may actually be determined by the sensors 166 during printing, and then the printing may be initiated if the borders are determined. Furthermore, the recording paper 16 at the borders between the image recorded sections of the ejection heads 153 may be marked to determine with a specific sensor easily.

On the other hand, high image quality mode makes the auxiliary heads 158 eject ink while reciprocating. At this time, the border areas are overwritten with small droplets. The printing speed decreases in this case, but the borders between the ejection heads 153 of the main head 152 and the auxiliary heads 158 become less conspicuous. Therefore, it is possible to make the border areas less conspicuous by ejecting ink while causing the auxiliary heads 158 to slightly oscillate.

Referring to the second embodiment, since the maintenance operation to the main head 152 can be performed during printing with the auxiliary heads 158, there is no loss in productivity. Also, the misalignment between the ejection heads 153 can be reduced because the ejection heads 153 constituting the main head 152 are capable of retracting and moving up and down.

Next, the third embodiment of the present invention is described below. The third embodiment is designed such that the ejection heads constituting the main head can be retracted individually in the width direction of the recording paper during the maintenance.

Figure 6A:
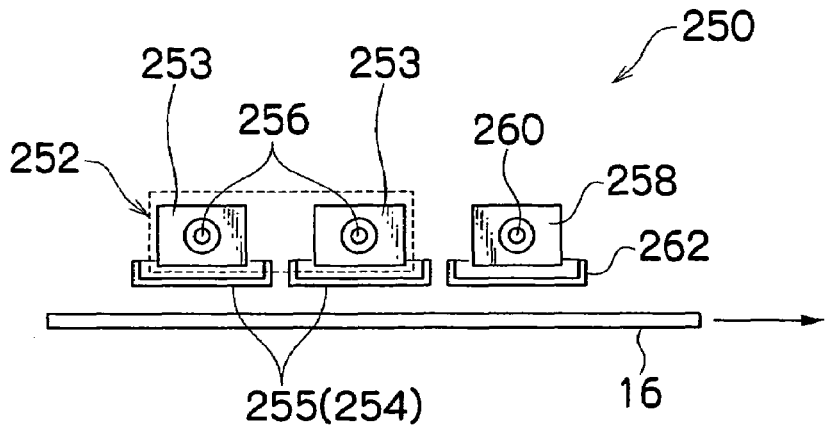
FIG. 6A is a side view showing the schematic configuration of an example of a print head unit according to third embodiment of the present invention.
Figure 6B:
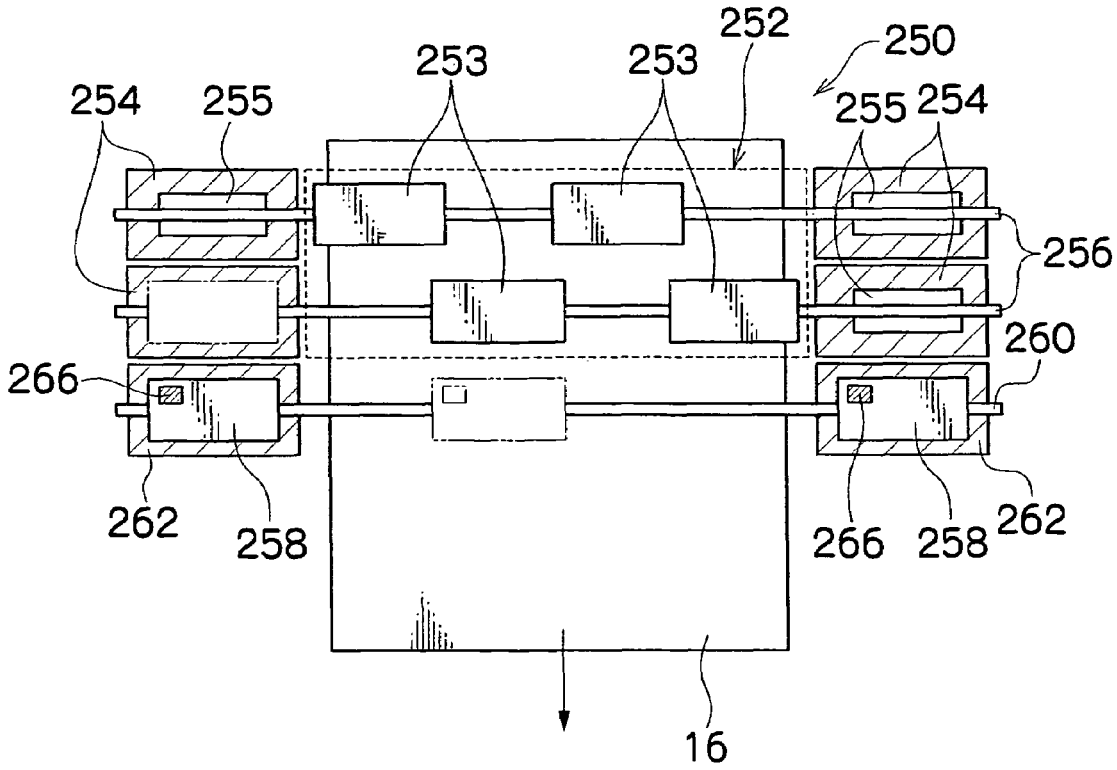
FIG. 6B is a plan view thereof.

FIG. 6A is a side view showing the schematic configuration of an example of a print head unit according to third embodiment of the present invention, and FIG. 6B is a plan view thereof.

As shown in FIG. 6A, in the third embodiment, rectangular shaped ejection heads 253 are attached to a drive shaft 256 as a head retracting device, and are designed to be able to move individually in the width direction of the recording paper 16. During the normal printing, the ejection heads 253 constituting a main head 252 are disposed so that all the image recorded sections formed by the ejection heads 253 are able to cover the entire width of the recording paper 16, as shown in FIG. 6B.

In the third embodiment, the maintenance units 254 as head recovery devices are installed on the outer side in the width direction of the recording paper 16, and include the caps 255. In this case, the maintenance units 254 are fixed in place not to move.

The auxiliary heads 258 in the third embodiment are similar to the auxiliary heads 58 in the first embodiment described above. The auxiliary heads 258 have the same shape and configuration as the ejection heads 253 constituting the main head 252. The auxiliary heads 258 are capable of moving in the width direction of the recording paper 16 (the direction substantially perpendicular to the paper conveyance direction) along a drive shaft 260, and are designed to normally remain in standby at the positions of the maintenance units 262 for the auxiliary heads 258 on the outer side in the width direction of the recording paper 16. The auxiliary heads 258 in the third embodiment are also provided with sensors 266 for accurately determining the sections on the recording paper 16 that correspond to the ejection heads 253 targeted for maintenance in the same way as the second embodiment.

Next, the maintenance operation in the third embodiment is described as the characteristic according to the third embodiment.

When the maintenance operation is performed, ejection of ink from the ejection heads 253 constituting the main head 252 targeted for maintenance is halted, and the proportionate task of ejecting is switched to the auxiliary heads 258. In other words, the auxiliary heads 258 are moved to the recording section on the recording paper 16 of the ejection heads 253 targeted for maintenance, the print data handled by the ejection heads 253 targeted for maintenance is sent to the auxiliary heads 258, and images are recorded by the auxiliary heads 258.

While the ejection is switched from the ejection heads 253 to the auxiliary heads 258, the ejection heads 253 targeted for maintenance are moved in the width direction of the recording paper 16 along the drive shaft 256 as a head retracting device. The ejection heads 253 are retracted to the positions of the caps 255 of the maintenance units 254 that are disposed on the outer side in the width direction, and then the maintenance operation is performed.

For the frequency by which the maintenance operation is performed, suctioning and blade cleaning may be performed in synchronization with the purging cycle in the same way as the first embodiment described above. Also, as described below, the time until the next maintenance cycle may be calculated based on the print data in the same way as the second embodiment described above.

For example, in the case in which the ejection state of the ejection heads 253 is determined from the print data, it is possible to calculate the time $T_1'$ until the next ejection of the ejection heads 253. If the maintenance cycle is determined, the remaining time $T_2'$ until maintenance is also determined by subtraction from the maintenance cycle. If the time required to transfer to the substitute ejection with the auxiliary heads 258 is $T_3'$, and the time required for returning is $T_4'$, the ejection heads 253 are transferred to a dormant state and are applied to the caps 255 when the relationship of $T_1'>T_3'+T_4'+\alpha$ is satisfied (i.e., when there is sufficient time until the next ejection). During the return process, the ejection heads 253 are transferred to their print standby positions after purging to the caps 255. At this time the auxiliary heads 258 remain at their standby positions above the maintenance units 262 for the auxiliary heads 258, and there is no need to move the auxiliary heads 258.

When the remaining time $T_2'$ until the next maintenance cycle is the same as the time $T_3'$ required to transfer to substitution ejection by the auxiliary heads 258 (i.e. $T_2'-T_3'=0$), the maintenance operation is performed on the ejection heads 253 while substitution ejection is performed by the auxiliary heads 258.

In the third embodiment, since the ejection heads 253 constituting the main head 252 are capable of being retracted individually, it is necessary to combine exactly with each image recorded sections formed by each ejection heads 253. In order to cope with those, the printing operation may be switched accordingly, depending on the printing mode. For example, during the normal printing mode and the high-speed printing mode, the auxiliary heads 258 are moved to the positions of the ejection heads 253 in the main head 252 that are targeted for maintenance, which positions are determined beforehand and stored as previously described, and the auxiliary heads 258 perform ejection in a fixed state.

On the other hand, high image quality mode makes the auxiliary heads 258 eject ink while reciprocating. At this time, the border areas are overwritten with small droplets. The printing speed decreases in this case, but the borders between the ejection heads 253 of the main head 252 and the auxiliary heads 258 become less conspicuous.

According to the third embodiment, there is no drop in productivity because maintenance can be performed during printing with the auxiliary heads 258, and the apparatus configuration is simple because the maintenance units 254 having the caps 255 are fixed in place on the outer side in the width direction of the recording paper 16 (the direction substantially perpendicular to the paper conveyance direction), and the ejection heads 253 constituting the main head 252 need only be moved to a position above the caps 255 along the drive shaft 256 provided along the width direction of the recording paper during maintenance.

Figure 7:
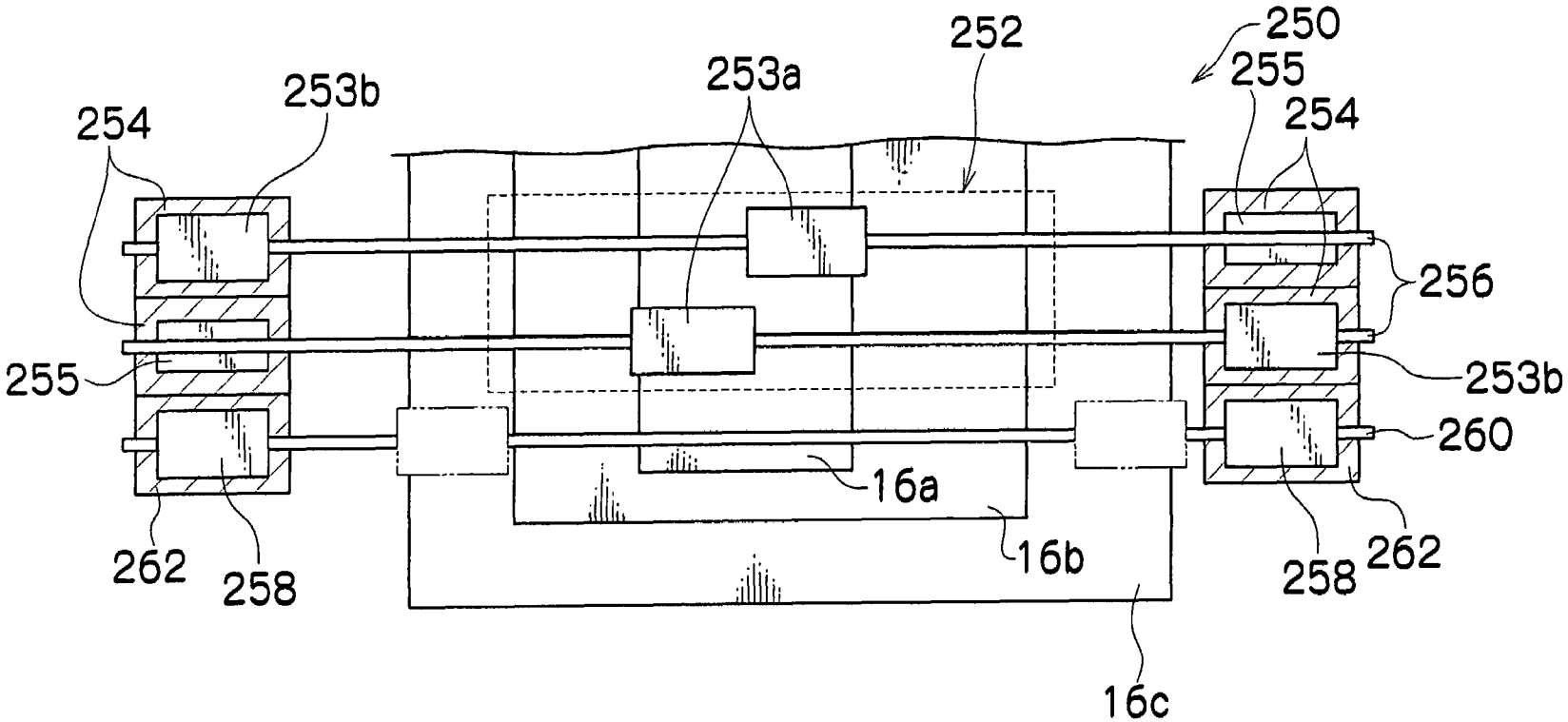
FIG. 7 is a plan view showing the schematic configuration of another example of a print head unit according to the third embodiment.

As shown in FIG. 7 according to another example of the third embodiment, when images are recorded on a narrow paper 16*a* (i.e., when only special ejection heads 253*a* from among the ejection heads 253 constituting the main head 252 are used), the ejection heads 253*b* not used for recording at this time may be used as auxiliary heads.

Also, it is possible to print on wide paper 16*c* in addition to narrow paper 16*a* and normal paper 16*b* by using the original auxiliary heads 258 for recording in addition to the main head 252, as shown in FIG. 7.

In each embodiments described above, a print head unit is provided for each color, and a main head and (one or more) auxiliary heads are also provided for each color, but another possibility is to segment one auxiliary head into multiple colors. However, in this case, it is necessary to make the auxiliary head eject ink while moving in the width direction of the recording paper (the so-called main scanning direction).

Also, instead of having a main head for each color, one main head may have ejection heads for all four colors YMCK, for example. In this case, the auxiliary head also has an alignment of ejection ports for four colors. However, in this case, it is required that special measures be taken regarding the ink supply system corresponding to each color to the auxiliary head, and the method in which printing is performed using the auxiliary head.

According to the above described embodiments of the present invention, it is possible to improve the productivity of the image forming apparatus (the inkjet recording apparatus) because the maintenance operation can be performed during printing. Also, since recording images is performed by reciprocating the auxiliary heads (including minute oscillation) while enabling the ejection heads to move individually, it is possible to record high quality images without forming the auxiliary heads in a line configuration. Therefore, it is also possible to miniaturize the auxiliary heads.

Also, since ink ejection can be recovered with the nozzles of the auxiliary heads instead of the nozzles of the main heads that could not be restored by the maintenance, it is possible to improve the reliability of the image forming apparatus (the inkjet recording apparatus). Furthermore, since recording images is performed by shuttle scanning with the auxiliary heads, it is possible to respond to breakdowns in the plurality of ejection heads constituting the main head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus in which image is formed on a recording medium by ejecting droplets onto the recording medium, comprising:

a plurality of ejection ports through which the droplets are ejected;

a plurality of ejection heads having the plurality of ejection ports aligned along a length corresponding to an entire width of a first type of recording medium;

a head recovery device configured to perform head recovery processing to recover from a defect of the ejection ports in the plurality of ejection heads;

a head retracting device configured to independently move each of the plurality of ejection heads to a retracted position for performing the head recovery processing; and an auxiliary head configured to move in a lateral direction substantially perpendicular to a conveyance direction of the recording medium, wherein the auxiliary head records the image onto the recording medium in substitution for one or more of the plurality of ejection heads while the head recovery processing is performed to the one or more of the plurality of ejection heads in the retracted position.

2. The image forming apparatus as defined in claim 1, wherein the auxiliary head reciprocates in the lateral direction substantially perpendicular to the conveyance direction of the recording medium so as to record the image onto the recording medium.

3. The image forming apparatus as defined in claim 1, wherein the auxiliary head is provided with a print determination device for determining whether the recording medium has been printed.

4. The image forming apparatus as defined in claim 1, wherein the head retracting device is configured to move the plurality of ejection heads to retracted positions by moving the ejection heads in a direction substantially perpendicular to a conveyance direction of the recording medium.

5. The image forming apparatus as defined in claim 4, wherein the head retracting device is configured to move the plurality of ejection heads to retracted positions by moving the ejection heads in a direction substantially perpendicular to the plane formed by the recording medium.

6. The image forming apparatus as defined in claim 1, wherein the auxiliary head is operable to be moved to an area on an outer side of an area printable by the plurality of ejection heads such that a maximum image recording area is enlarged by the auxiliary head performing printing in conjunction with the plurality of ejection heads.

7. The image forming apparatus as defined in claim 1, further comprising one or more additional auxiliary heads configured to move in a lateral direction substantially perpendicular to a conveyance direction of the recording medium.

8. The image forming apparatus as defined in claim 7, wherein the one or more additional auxiliary heads are operable to be moved to areas on outer sides of an area printable by the plurality of ejection heads such that a maximum image recording area is enlarged by the auxiliary heads performing printing in conjunction with the plurality of ejection heads.

9. The image forming apparatus as defined in claim 7, wherein the one or more additional auxiliary heads record the image onto a part of an image recording area for being recorded by one or more ejection heads which have been retracted by the head retracting device.

10. The image forming apparatus as defined in claim 1, wherein the image forming apparatus is configured to form an image on a second type of recording medium, the second type of recording medium having a width less than that of the first type of recording medium, whereby each of the plurality of ejection heads is operable as an auxiliary head to substitute for the recording of another of the plurality of ejection heads while the another ejection head is in the retracted position.

11. The image forming apparatus as defined in claim 1, wherein the auxiliary head has a configuration similar to one of the plurality of ejection heads.

12. An image forming apparatus in which image is formed on a recording medium by ejecting droplets onto the recording medium, comprising:

a plurality of ejection ports through which the droplets are ejected;

a plurality of ejection heads having the plurality of ejection ports aligned along a length corresponding to an entire width of a first type of recording medium;

a head recovery device configured to perform head recovery processing to recover from a defect of the ejection ports in the plurality of ejection heads;

a head retracting device configured to independently move each of the plurality of ejection heads to an image recording position for performing image recording and to a retracted position for performing the head recovery processing; and an auxiliary head configured to move in a lateral direction substantially perpendicular to a conveyance direction of the recording medium, wherein while head recovery processing is performed to one or more of the plurality of ejection heads in the retracted position, the auxiliary head records the image onto the recording medium in substitution for the one or more of the plurality of ejection heads by being disposed in a position in a fixed state to record a part of an image recording area of the recording medium normally recorded by the one or more of the plurality of ejection heads in the image recording position.

13. The image forming apparatus as defined in claim 12, wherein the auxiliary head is provided with a print determination device for determining whether the recording medium has been printed.

14. The image forming apparatus as defined in claim 12, wherein the head retracting device configured to move the plurality of ejection heads to retracted positions by moving the ejection heads in a direction substantially perpendicular to a conveyance direction of the recording medium.

15. The image forming apparatus as defined in claim 14, wherein the head retracting device is configured to move the plurality of ejection heads to retracted positions by moving the ejection heads in a direction substantially perpendicular to the plane formed by the recording medium.

16. The image forming apparatus as defined in claim 12, wherein the auxiliary head is operable to be moved to an area on an outer side of an area printable by the plurality of ejection heads such that a maximum image recording area is enlarged by the auxiliary head performing printing in conjunction with the plurality of ejection heads.

17. The image forming apparatus as defined in claim 12, further comprising one or more additional auxiliary heads which are configured to move in a lateral direction substantially perpendicular to a conveyance direction of the recording medium.

18. The image forming apparatus as defined in claim 17, wherein the one or more additional auxiliary heads are operable to be moved to areas on outer sides of an area printable by the plurality of ejection heads such that a maximum image recording area is enlarged by the auxiliary heads performing printing in conjunction with the plurality of ejection heads.

19. The image forming apparatus as defined in claim 17, wherein the one or more additional auxiliary heads record the image onto a part of an image recording area for being recorded by one or more ejection heads which have been retracted by the head retracting device.

20. The image forming apparatus as defined in claim 12, wherein the image forming apparatus is configured to form an image on a second type of recording medium, the second type of recording medium having a width less than that of the first type of recording medium, whereby each of the plurality of ejection heads is operable as an auxiliary head to substitute for the recording of another of the plurality of ejection heads while the another ejection head is in the retracted position.

21. The image forming apparatus as defined in claim 12, wherein the auxiliary head has a configuration similar to one of the plurality of ejection heads.

* * * * *